US008591006B2

(12) United States Patent
Xiao

(10) Patent No.: US 8,591,006 B2
(45) **Date of Patent: *Nov. 26, 2013**

(54) ADAPTER AND AN INK CARTRIDGE MOUNTED ON AN INK-JET PRINTER

(75) Inventor: Biao Xiao, Zhuhai (CN)

(73) Assignee: Zhuhai Ninestar Management Co., Ltd., Guangdong (CN)

( * ) Notice: Subject to any disclaimer, the term of this patent is extended or adjusted under 35 U.S.C. 154(b) by 0 days.

This patent is subject to a terminal disclaimer.

(21) Appl. No.: 13/295,008

(22) Filed: Nov. 11, 2011

(65) Prior Publication Data

US 2012/0056957 A1 Mar. 8, 2012

Related U.S. Application Data

(63) Continuation of application No. PCT/CN2010/072732, filed on May 13, 2010.

(30) Foreign Application Priority Data

May 13, 2009 (CN) ..... 2009 2 0056671 U

(51) Int. Cl.
*B41J 2/14* (2006.01)
*B41J 2/16* (2006.01)

(52) U.S. Cl.
USPC ..... 347/50

(58) Field of Classification Search
USPC ..... 347/50
See application file for complete search history.

(56) References Cited

U.S. PATENT DOCUMENTS

| | | | | |
|---|---|---|---|---|
| 6,398,335 | B1 * | 6/2002 | Benjamin | 347/19 |
| 2005/0212877 | A1 | 9/2005 | Liang | 347/86 |
| 2009/0051746 | A1 * | 2/2009 | Asauchi | 347/86 |

FOREIGN PATENT DOCUMENTS

| | | | |
|---|---|---|---|
| CN | 101195302 | A | 6/2008 |
| CN | 101518991 | A | 9/2009 |
| CN | 201419542 | Y | 3/2010 |
| CN | 201456561 | U | 5/2010 |
| DE | 199 17 229 | A1 | 10/2000 |
| EP | 0 440 261 | A2 | 8/1991 |
| EP | 1 564 004 | A1 | 8/2005 |
| EP | 1 854 632 | A1 | 11/2007 |
| EP | 1 905 596 | A1 | 4/2008 |

OTHER PUBLICATIONS

International Search Report of international PCT application No. PCT/CN2010/072732, issued on Aug. 19, 2010.

* cited by examiner

*Primary Examiner* — Matthew Luu
*Assistant Examiner* — Renee I Wilson
(74) *Attorney, Agent, or Firm* — J.C. Patents

(57) ABSTRACT

The invention relates to an adapter and an ink cartridge mounted on an ink-jet printer. An adapter comprises an inner chamber for accommodating the ink cartridge and a chip set on the adapter, wherein the said chip has a contact surface with the printer, the contact surface provided with an information contact and two electrical detecting contacts; a non-contact trigger switch is set on the back surface of the said chip opposite to the two electrical detecting contacts; the said non-contact trigger switch is electrically connected with two electrical detecting contacts respectively; the said non-contact trigger switch is triggered to become disconnected at least once by the non-contact trigger mechanism on the ink cartridge when the ink cartridge is being inserted into the printer and is not triggered by the non-contact trigger mechanism so as to keep the connected status after the ink cartridge is inserted into the printer.

13 Claims, 8 Drawing Sheets

ADAPTER AND AN INK CARTRIDGE MOUNTED ON AN INK-JET PRINTER

CROSS-REFERENCE TO RELATED APPLICATIONS

This application is a continuation of International Application No. PCT/CN2010/072732, filed on May 13, 2010, which claims the priority benefit of China Patent Application No. 200920056671.4, filed on May 13, 2009. The contents of the above identified applications are incorporated herein by reference in their entirety.

FIELD OF THE TECHNOLOGY

The present invention relates to an adapter and an ink cartridge mounted on an ink-jet printer.

BACKGROUND

Some users choose the adapters and ink cartridges specific for the serial models of ink printers in prior art, as illustrated in FIG. 1, their structures mainly comprising an ink chamber for accommodating ink, an ink outlet for supplying ink to the printing head of the printer, an air inlet section, a valve structure for keeping the ink chamber a stable negative pressure, a chip for sending ink cartridge information to the printer and an printer adapter for positioning the chip, which are operated in such a manner: firstly mount the adapter that includes a chip bearing the ink information into the printer; after the adapter is mounted into the printer, all contacts on the chip fit closely with those on the printer; then mount the ink cartridge into the adapter with the ink supply needle of the printer inserted into the ink outlet of the ink cartridge; the printer starts working normally; after the ink is run out, the chip is automatically reset and the printer alarms to replace the ink cartridge; take out the ink cartridge to replace a new one; and after reading the ink information of new cartridge, the printer continues working.

In the aforesaid prior art, the chip included in the adapter is automatically reset, which makes the replacement of cartridge possible without taking the adapter out of the printer.

However, some series of printers in prior art are provided with a set of programs, which makes the chip not reset unless detached with the printer, wherein, when replacing the ink cartridge, the user using the adapter must take out both the ink cartridge and the adapter and re-install those to complete the replacement. Hence this adds in the adapter disassembly and assembly process, reduces the service life of the adapter and increases the workload and cost of the user.

SUMMARY

The present invention provides an adapter and a cartridge mounted on an ink-jet printer to solve the existing technical problem that the adapter must be taken out from the printer when the ink cartridge is re-installed into the adapter.

In order to solve the aforesaid technical problem, the present invention adopts the following technical art:

An adapter mounted on an ink-jet printer, comprising an inner chamber for accommodating the ink cartridge and a chip set on the adapter, wherein the said chip has a contact surface with the printer, the contact surface provided with an information contact and two electrical detecting contacts which are electrically connected with the printer; the said chip is provided with a non-contact trigger switch comprising an elastic apparatus, a ferromagnetic apparatus and contacts respectively electrically connected with the said two electrical detecting contacts; the said non-contact trigger switch is triggered to become disconnected at least once by the non-contact trigger mechanism on the ink cartridge when the ink cartridge is being inserted into the printer and is not triggered by the non-contact trigger mechanism so as to keep the connected status after the ink cartridge is inserted into the printer.

An adapter mounted on an ink-jet printer as described above, wherein the said chip is set on the surface of the side wall where the adapter and the printing head have their corresponding contacts jointed, the said chip has a contact surface with the printer, the contact surface provided with an information contact and two electrical detecting contacts which are electrically connected with the printer, and the said non-contact trigger switch is respectively electrically connected with two electrical detecting contacts.

An adapter mounted on an ink-jet printer as described above, wherein the said non-contact trigger switch is connected and disconnected by controlling the magnetic field force between the said non-contact trigger switch and the non-contact trigger mechanism.

An adapter mounted on an ink-jet printer as described above, wherein the said non-contact trigger switch is a normally closed magnetic switch, which has a metal that generates magnetic force with the non-contact trigger mechanism.

An ink cartridge specific for the said adapter mounted on an ink-jet printer as described above, wherein the said ink cartridge is set with a non-contact trigger mechanism that matches the non-contact trigger switch of the chip.

An ink cartridge as described above, wherein the said non-contact trigger mechanism is a magnet that can generate magnetic action with the non-contact trigger switch.

An ink cartridge as described above, wherein the magnetic flux of the magnet on the said non-contact trigger mechanism is 1000~5000 gauss.

An ink cartridge as described above, wherein the said non-contact trigger mechanism is pre-embedded in the ink cartridge of the side wall opposite to the non-contact trigger switch of the adapter chip, the trigger travel path of the said non-contact trigger mechanism passing through the trigger area of the non-contact trigger switch.

An ink cartridge as described above, wherein the said non-contact trigger mechanism is set on the side wall of the ink cartridge in a fixed manner, the trigger travel path of the said non-contact trigger mechanism passing through the trigger area of the non-contact trigger switch.

An ink cartridge as described above, wherein the said non-contact trigger mechanism is set on the side wall of the ink cartridge in a removable manner, the trigger travel path of the said non-contact trigger mechanism passing through the trigger area of the non-contact trigger switch.

An ink cartridge as described above, wherein the trigger travel path of the said non-contact trigger mechanism passes through the trigger area of the non-contact trigger switch, and the effective distance between the non-contact trigger mechanism and the non-contact trigger switch in the trigger area is 3~10 mm.

Upon the adoption of the said technical art, the said non-contact trigger switch is triggered to become disconnected at least once by the non-contact trigger mechanism on the ink cartridge when the ink cartridge is being inserted into the printer and is not triggered by the non-contact trigger mechanism so as to keep the connected status after the ink cartridge is inserted into the printer. Therefore, when the ink cartridge is being inserted into the printer adapter, it is disconnected at least once. After the insertion, the chip is connected with the printer. When the ink cartridge is taken out from the printer adapter which is not taken out from the printer, the chip is disconnected from the printer. This solves the existing technical problem that the adapter must be taken out from the printer when the ink cartridge is re-installed into the adapter.

FIGURE IDENTIFICATIONS

| | | |
|---|---|---|
| 1- Chip; | 2- Adapter; | 3- Switch; |
| 4- Non-contact trigger mechanism; | 5- Cartridge; | 4- Gating cavity; |
| 31- Contacts connected with Electrical detecting contacts; | 32- Spring; | 33- Ferromagnetic substance |

DETAILED DESCRIPTION

Figure 1:
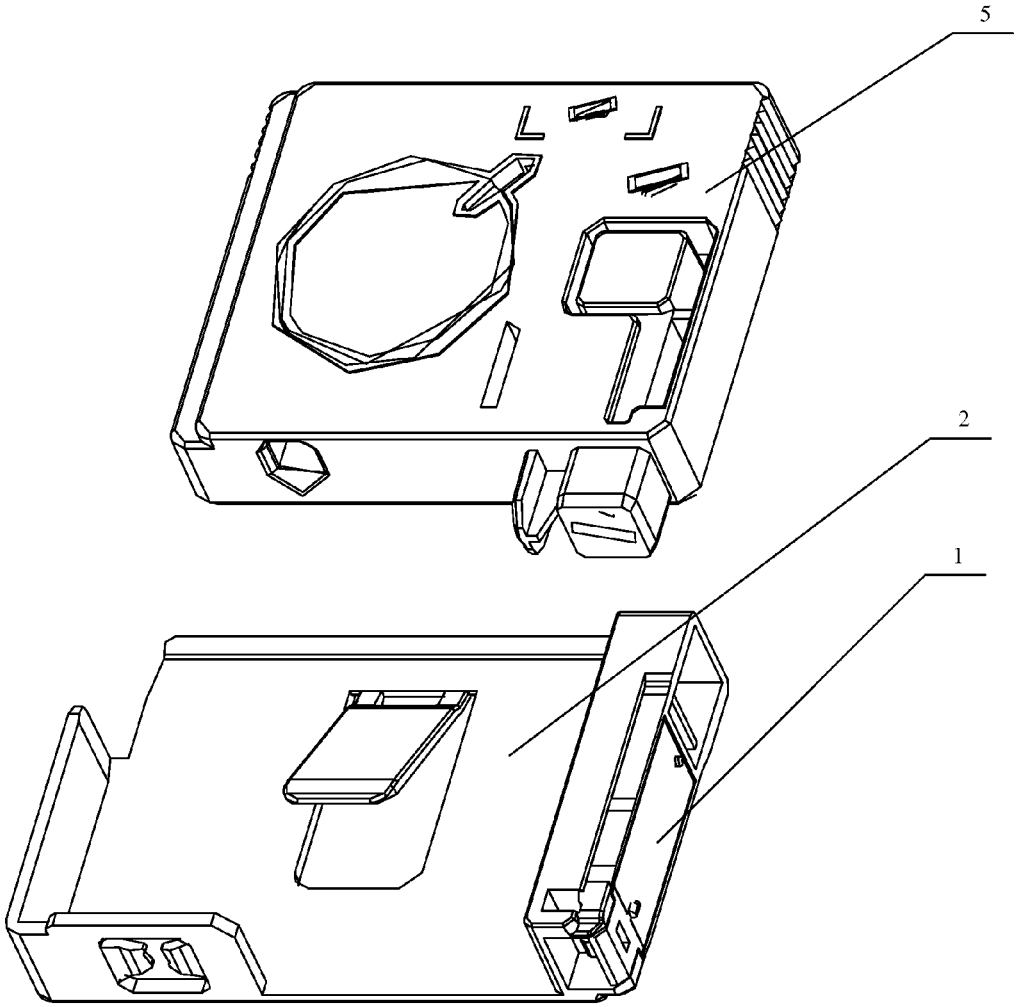
FIG. 1 shows the prior printer adapter and ink cartridge.
Figure 2:
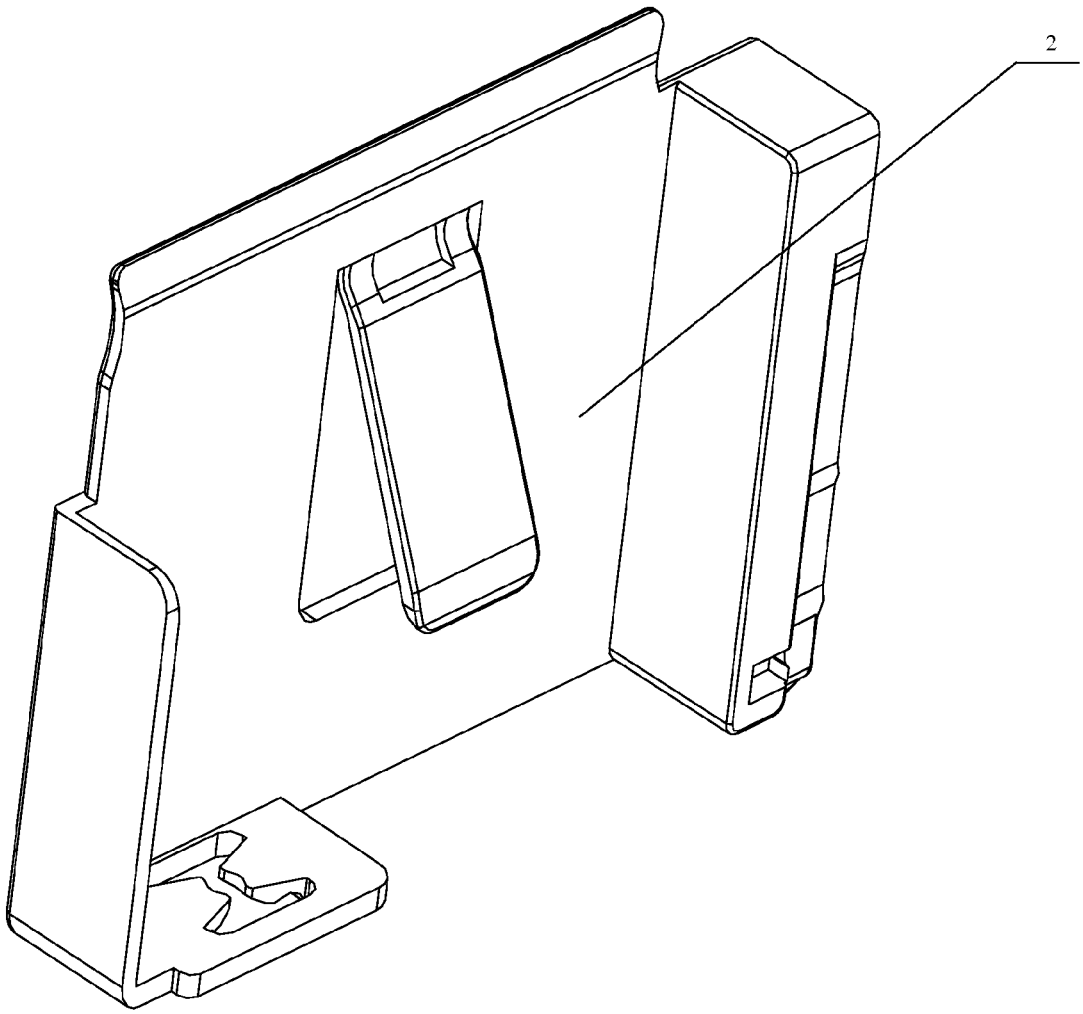
FIG. 2 shows the embodiment of the adapter mounted on an ink-jet printer in the present invention.
Figure 3:
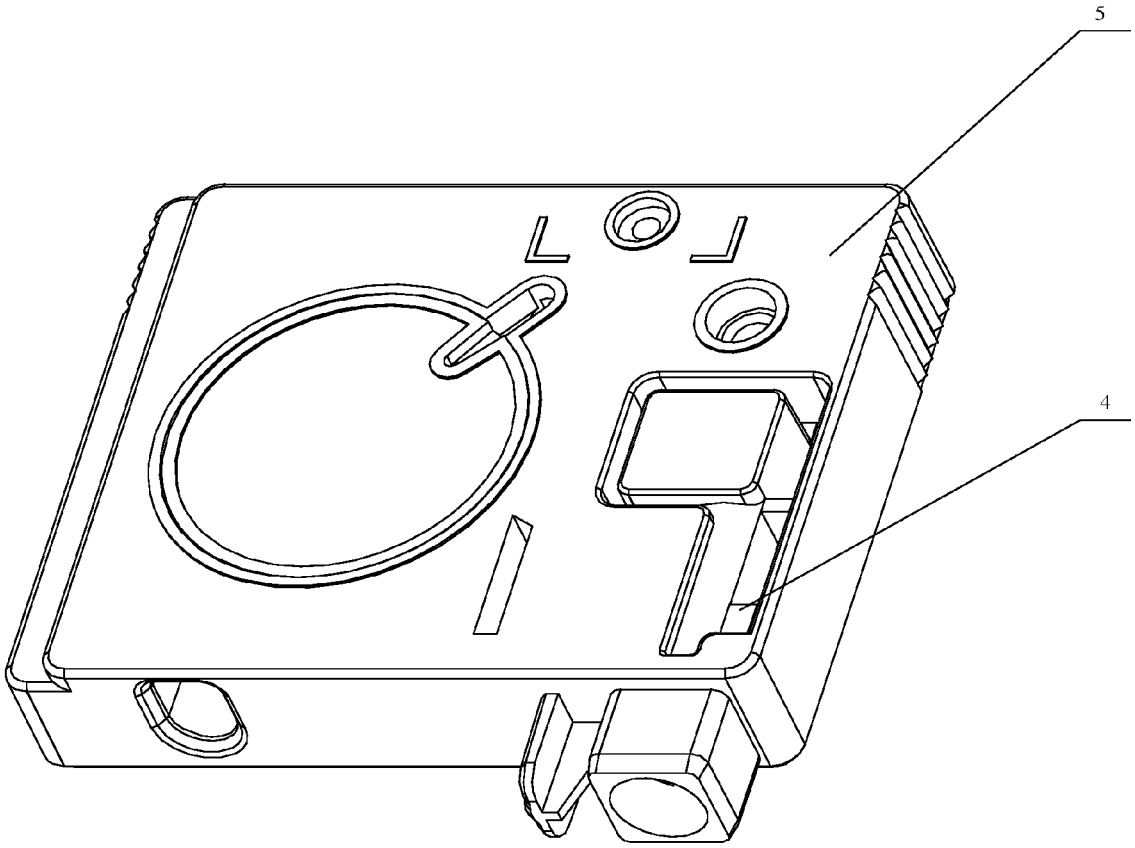
FIG. 3 shows the embodiment of the ink cartridge in the present invention.
Figure 4:
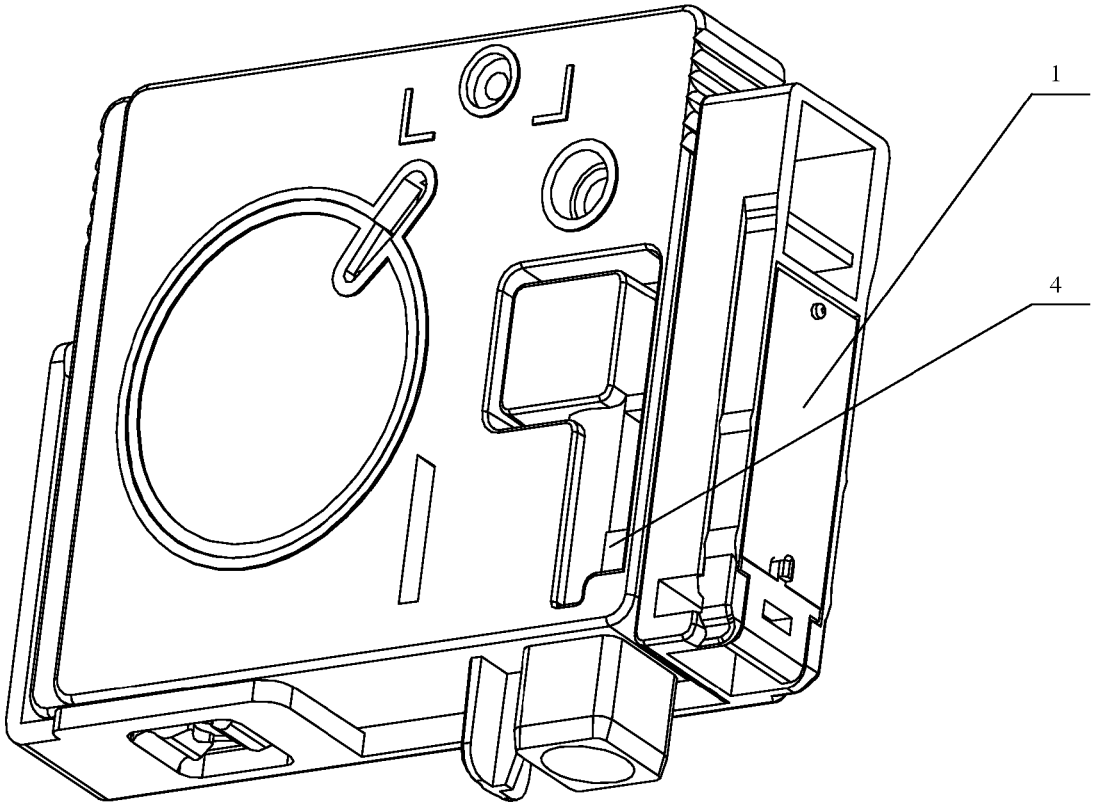
FIG. 4 shows the chip switch in the embodiment of the present invention.
Figure 5:
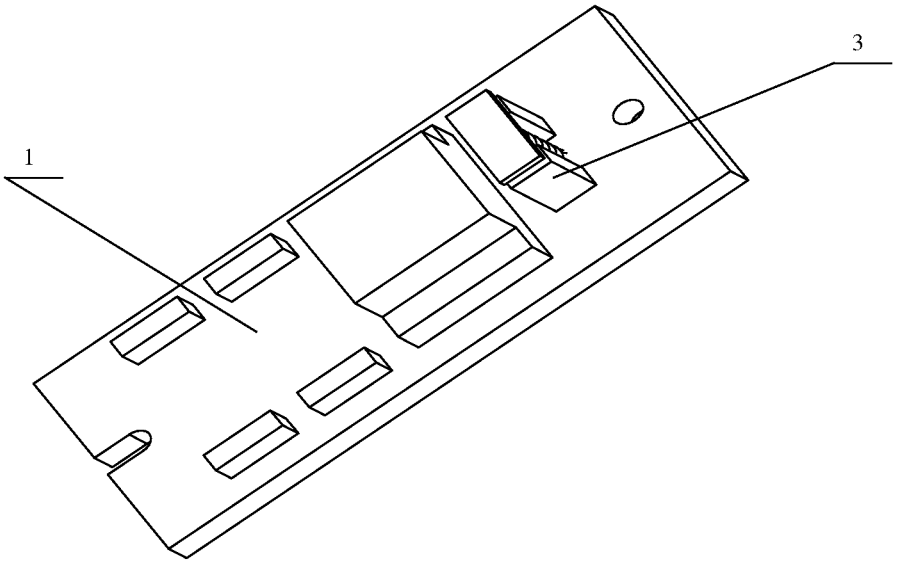
FIG. 5 shows the chip shape in the embodiment of the present invention.
Figure 6:
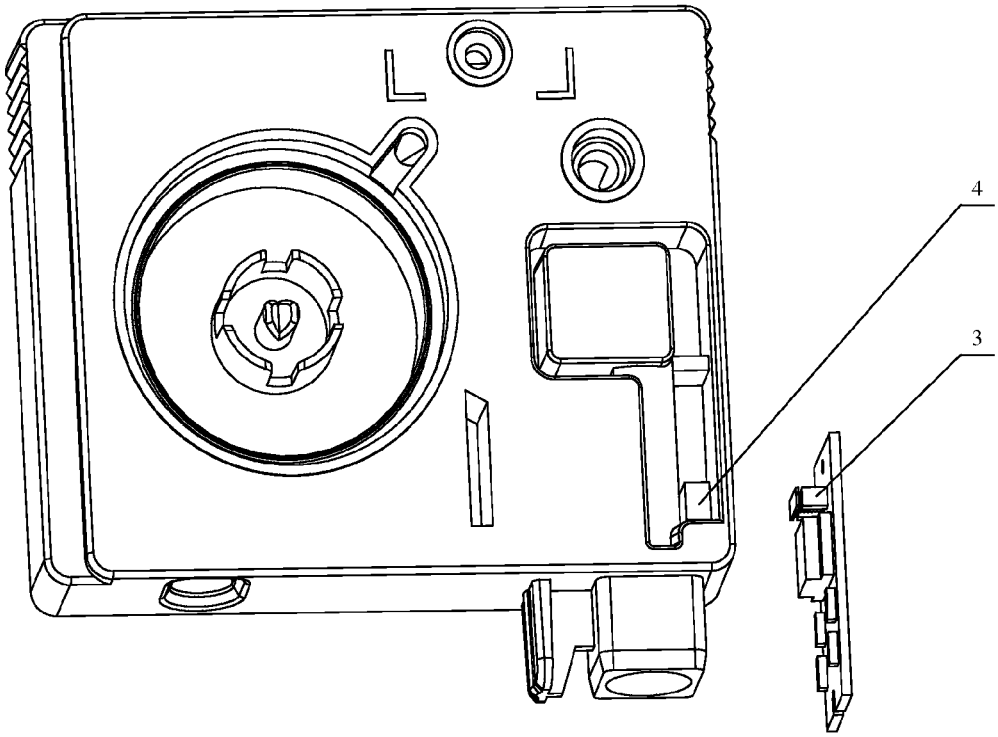
FIG. 6 shows the relative position between the ink cartridge and the chip during the assembly process with the switch disconnected in the embodiment of the present invention.
Figure 7:
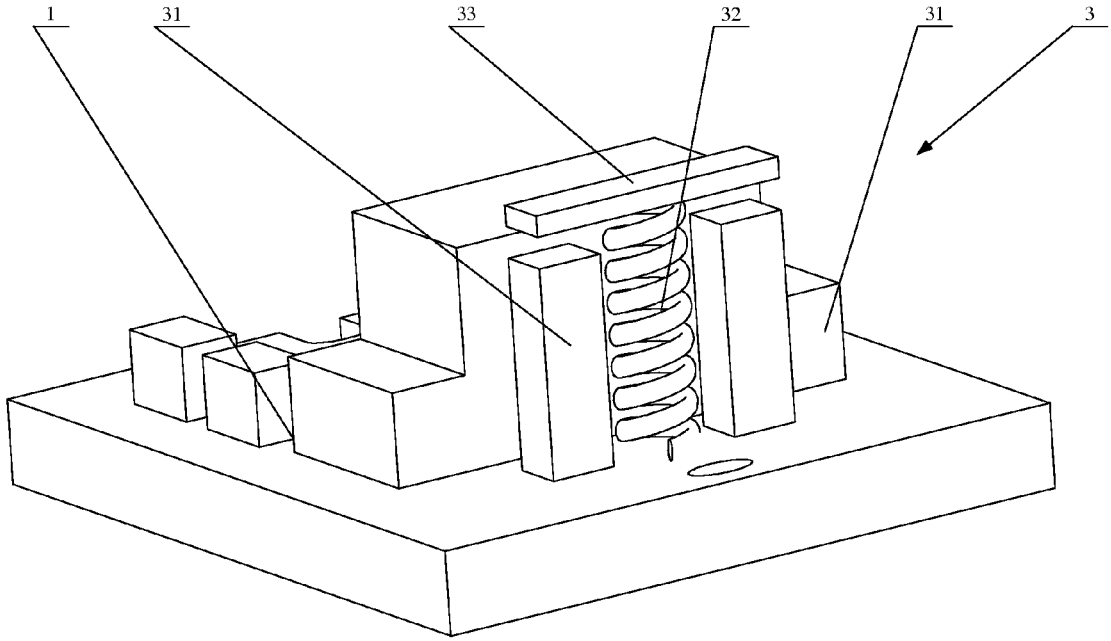
FIG. 7 shows the disconnected chip switch during the assembly process in the embodiment of the present invention.
Figure 8:
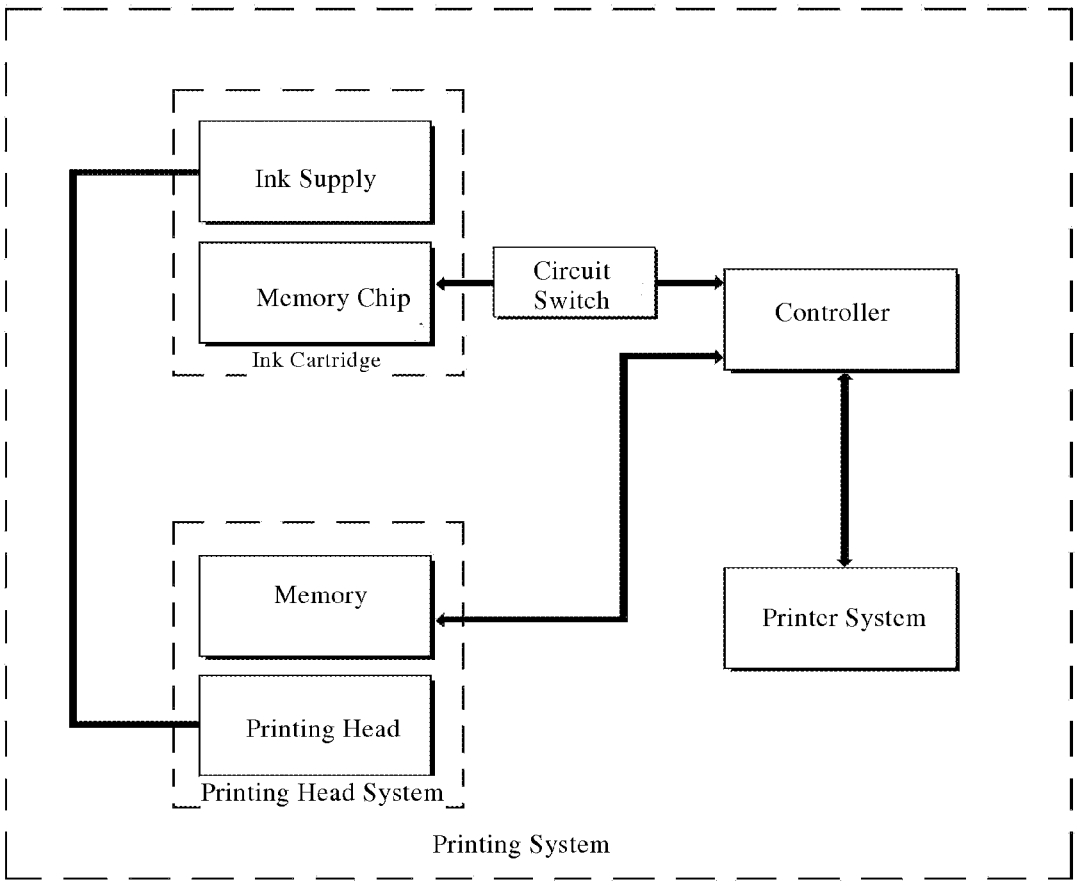
FIG. 8 shows the modular circuit diagram of the printing system for the embodiment of the present invention.

As shown in FIG. 2~FIG. 8, an adapter 2 mounted on an ink-jet printer comprises an inner chamber to accommodate the ink cartridge 5 and a chip 1 set outside the adapter 2, wherein the chip 1 has the contact surface with the printer, the contact surface provided with an information contact, two electrical detecting contacts and a memory to store the ink information, which are electrically connected with the printer. When the ink volume information in the chip 1 reaches a certain value, the reset unit will automatically reset the ink volume information and the printer will alarm to replace the ink cartridge 5. Take out the ink cartridge 5 from the adapter 2. When the non-contact trigger mechanism 4 passes through the acting scope of the switch 3, the ferromagnetic substance 33 in the magnetic switch 3 is attracted by the non-contact trigger mechanism 4 to move towards the non-contact trigger mechanism 4, departing from the original closed position, as shown in FIG. 7. In this case, the internal circuit of the chip 1 is disconnected. After the non-contact trigger mechanism 4 is out of the acting scope of the magnetic switch 3, the ferromagnetic substance is attracted by the elastic apparatus to move towards the contact 31 that is connected with the electrical detecting contact till they contact. In this case, the internal circuit of the chip 1 is connected again. After a new ink cartridge 5 is installed, the trigger unit will disconnect the circuit of the chip 1 again. The printer reads the ink information in the chip 1. The chip 1 has a rear surface opposite to the two electrical detecting contacts, the rear surface provided with a non-contact trigger switch 3. The contact 31 of the non-contact trigger switch 3 connected with the electrical detecting contact is electrically connected with the two electrical detecting contacts respectively. The non-contact trigger switch is triggered by the non-contact trigger mechanism 4 on the ink cartridge 5 as shown in FIG. 3 to become disconnected at least once when the ink cartridge 5 is being inserted into the printer and is not triggered by the non-contact trigger mechanism so as to keep the connected status after the ink cartridge 5 is inserted into the printer. The non-contact trigger switch is connected and disconnected by controlling the magnetic field force between the non-contact trigger switch and the non-contact trigger mechanism 4. The non-contact trigger switch is a normally closed magnetic switch 3, which has the ferromagnetic substance 33 that generates magnetic force with the non-contact trigger mechanism. The non-contact trigger mechanism 4 is the magnet that generates magnetic force with normally closed switch 3. The magnetic flux of the magnet on the said non-contact trigger mechanism is 1000~5000 gauss.

Firstly mount the adapter into the printer. In this case, the circuit of the chip 1 is connected and the printer reads the information in the chip 1. Then, install the ink cartridge 5 into the adapter 2, as shown in FIG. 6, during which the non-contact trigger mechanism 4 on the side wall of the ink cartridge 5 passes through the acting scope of the magnetic switch 3 of the chip 1, the internal circuit of the chip 1 is disconnected. Then, continue installing the ink cartridge 5 to make it out of the acting scope of the magnetic switch 3 of the chip 1 till it is installed on the preset position and the circuit of the chip 1 is connected. In this case, the printer alarms that an ink cartridge 5 is present and reads the ink information. The printer indicates that the newly installed ink cartridge 5 is available for use.

After the ink is run out, the chip 1 is reset automatically. The printer indicates to replace the ink cartridge 5. When the ink cartridge 5 is taken out from the printer adapter 2, the trigger unit on the side wall of the ink cartridge 5 passes through the acting scope of magnetic switch 3 of the chip 1 again. The circuit of the chip 1 is discontented once more. After the new ink cartridge 5 is installed, the trigger unit of the ink cartridge 5 connects and disconnects the internal circuit of the chip 1 once more. In this case, the printer reads the reset ink information and continues working.

In the present invention, the chip 1 is activated by using the trigger unit on the side wall of the ink cartridge 5 to trigger the chip 1 switch, so as to make the printer read the ink information and detect the presence of the ink cartridge 5. As a result, the adapter 2 can be installed into the printer permanently and the user only needs to replace the ink cartridge 5 without the chip 1. The present invention also provides a cost effective and easy-to-use ink cartridge 5.

It should be noted that the above-mentioned embodiments illustrate rather than limit the present invention. While the invention is described in detail through the aforesaid embodiments, it should be understood by those skilled in the art that they will be able to modify the technical art as explained in the aforesaid embodiments or design alternative embodiments equivalent to some technical characteristics therein, without departing from the spirit and scope of the appended claims.

What is claimed is:

1. An adapter mounted on an ink-jet printer, comprising an inner chamber for accommodating an ink cartridge and a chip set on the adapter, wherein said chip has a contact surface contacting with the printer, the contact surface is provided with an information contact and two detecting electrical contacts, and said information contact and two detecting electrical contacts are electrically connected with the printer, characterized in that a memory for storing an ink information is arranged on the chip, and said chip is provided with a non-contact trigger switch comprising an elastic component, a ferromagnetic component connected with the elastic component and contacts, the contacts of the non-contact trigger switch are electrically connected with said two detecting electrical contacts respectively, when a non-contact trigger mechanism on the ink cartridge passes through an acting scope of the non-contact trigger switch, the ferromagnetic component is attracted by the non-contact trigger mechanism to move towards the non-contact trigger mechanism and become disconnected with the contacts of the non-contact trigger switch, and after the non-contact trigger mechanism is out of the acting scope of the non-contact trigger switch, the ferromagnetic component is attracted by the elastic component to move towards the contacts of the non-contact trigger switch till they contact.

2. The adapter mounted on the ink-jet printer as claimed in claim 1, characterized in that said chip is set on a surface of a side wall where the adapter and a printing head have their corresponding contacts jointed.

3. The adapter mounted on the ink-jet printer as claimed in claim 1, characterized in that said memory is set in an enclosed space between a back of a circuit board and the adapter.

4. The adapter mounted on the ink-jet printer as claimed in claim 1, characterized in that said non-contact trigger switch is set on a back surface opposite to or the same surface of the two detecting electrical contacts of said chip.

5. An ink cartridge specific for the adapter mounted on the ink-jet printer as claimed in claim 1, characterized in that said ink cartridge is set with a non-contact trigger mechanism that matches the non-contact trigger switch of the chip.

6. The ink cartridge as claimed in claim 5, characterized in that said non-contact trigger mechanism is a magnet that can generate a magnetic action with the non-contact trigger switch.

7. The ink cartridge as claimed in claim 6, characterized in that a magnetic flux of the magnet of the said non-contact trigger mechanism is 1000~5000 gauss.

8. The ink cartridge as claimed in claim 5, characterized in that said non-contact trigger mechanism is pre-embedded in the ink cartridge at a side wall corresponding to the non-contact trigger switch of the chip, and a trigger travel path of said non-contact trigger mechanism passes through a trigger area of the non-contact trigger switch.

9. The ink cartridge as claimed in claim 5, characterized in that said non-contact trigger mechanism is set on a side wall of the ink cartridge in a fixed manner, and a trigger travel path of said non-contact trigger mechanism passes through a trigger area of the non-contact trigger switch.

10. The ink cartridge as claimed in claim 5, characterized in that said non-contact trigger mechanism is set on a side wall of the ink cartridge in a movable manner, and a trigger travel path of said non-contact trigger mechanism passes through a trigger area of the non-contact trigger switch.

11. The ink cartridge as claimed in claim 9, characterized in that the trigger travel path of said non-contact trigger mechanism passes through the trigger area of the non-contact trigger switch, and an effective action distance between the non-contact trigger mechanism and the non-contact trigger switch in the trigger area is 3~10mm.

12. The ink cartridge as claimed in claim 10, characterized in that the trigger travel path of said non-contact trigger mechanism passes through the trigger area of the non-contact trigger switch, and an effective action distance between the non-contact trigger mechanism and the non-contact trigger switch in the trigger area is 3~10mm.

13. The adapter as claimed in claim 1, characterized in that the acting scope of the non-contact trigger switch is 3~10mm.

* * * * *